US008471451B2

(12) United States Patent
Ma

(10) Patent No.: US 8,471,451 B2
(45) Date of Patent: Jun. 25, 2013

(54) RUTHENIUM-BASED ELECTRODE MATERIAL FOR A SPARK PLUG

(75) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/342,709

(22) Filed: Jan. 3, 2012

(65) Prior Publication Data

US 2012/0169206 A1 Jul. 5, 2012

Related U.S. Application Data

(60) Provisional application No. 61/429,808, filed on Jan. 5, 2011.

(51) Int. Cl.
*H01T 13/39* (2006.01)

(52) U.S. Cl.
USPC ..... 313/141; 313/143

(58) Field of Classification Search
USPC ..... 313/118–145
See application file for complete search history.

(56) References Cited

U.S. PATENT DOCUMENTS

| | | | |
|---|---|---|---|
| 2,328,580 | A | 9/1943 | Pickus |
| 2,391,456 | A | 12/1945 | Hensel |
| 2,391,457 | A | 12/1945 | Carlson |
| 2,406,172 | A | 8/1946 | Smithells |
| 2,470,034 | A | 5/1949 | Hensel |
| 2,545,438 | A | 3/1951 | Stumbpck |
| 3,159,460 | A | 12/1964 | Hill |
| 3,278,280 | A | 10/1966 | Holtz |
| 3,362,799 | A | 1/1968 | Fletcher |
| 3,528,862 | A | 9/1970 | Jones |
| 3,868,430 | A | 2/1975 | Giangaspero |
| 3,957,451 | A | 5/1976 | Rasmussen |
| 3,977,841 | A | 8/1976 | Rasmussen |
| 4,324,588 | A | 4/1982 | Zysk |

(Continued)

FOREIGN PATENT DOCUMENTS

| | | | |
|---|---|---|---|
| EP | 1123985 | A1 * | 8/2001 |
| GB | 556253 | | 9/1943 |

(Continued)

OTHER PUBLICATIONS

Written Opinion & International Search Report for PCT/US12/20130 Aug. 28, 2012, 9 pages.

(Continued)

*Primary Examiner* — Mariceli Santiago
(74) *Attorney, Agent, or Firm* — Reising Ethington P.C.

(57) ABSTRACT

A ruthenium-based electrode material for use with a spark plug. The electrode material comprises ruthenium (Ru) and a precious metal. The ruthenium (Ru) is the single largest constituent of the electrode material on a wt % basis. The electrode material may have a density that is less than or equal to about 15.5 g/cm$^3$ and may include at least one other precious metal. The electrode material may be used in a spark plug that includes a metallic shell having an axial bore, an insulator having an axial bore and at least partially disposed within the axial bore of the metallic shell, a center electrode at least partially disposed within the axial bore of the insulator, and a ground electrode attached to a free end of the metallic shell. The center electrode, the ground electrode or both may be formed at least in part from the electrode alloy.

22 Claims, 4 Drawing Sheets

U.S. PATENT DOCUMENTS

| | | | | |
|---|---|---|---|---|
| 4,351,095 | A | | 9/1982 | Davies |
| 4,427,915 | A | | 1/1984 | Nishio |
| 4,659,960 | A | | 4/1987 | Toya |
| 4,692,657 | A | | 9/1987 | Grunwald |
| 4,743,793 | A | | 5/1988 | Toya |
| 4,771,209 | A | | 9/1988 | Ryan |
| 4,786,267 | A | | 11/1988 | Toya |
| 4,881,913 | A | | 11/1989 | Mann |
| 4,910,428 | A | | 3/1990 | Strumbos |
| 4,939,409 | A | | 7/1990 | Freise |
| 5,101,135 | A | | 3/1992 | Oshima |
| 5,347,193 | A | | 9/1994 | Oshima |
| 5,448,130 | A | | 9/1995 | Matsutani |
| 5,456,624 | A | | 10/1995 | Moore |
| 5,461,275 | A | | 10/1995 | Oshima |
| 5,514,929 | A | | 5/1996 | Kawamura |
| 5,550,425 | A | | 8/1996 | Yoder |
| 5,578,895 | A | | 11/1996 | Oshima |
| 5,675,209 | A | | 10/1997 | Hall, Jr. |
| 5,793,793 | A | | 8/1998 | Matsutani |
| 5,796,019 | A | | 8/1998 | Lupton |
| 5,866,973 | A | | 2/1999 | Kagawa |
| 5,869,921 | A | | 2/1999 | Matsutani |
| 5,890,272 | A | | 4/1999 | Liberman |
| 5,894,186 | A | | 4/1999 | Matsutani |
| 5,898,257 | A | | 4/1999 | Sequerra |
| 5,990,602 | A | | 11/1999 | Katoh |
| 5,997,695 | A | | 12/1999 | Ilmarinen |
| 5,998,913 | A | * | 12/1999 | Matsutani ..... 313/141 |
| 6,045,424 | A | | 4/2000 | Chang |
| 6,046,532 | A | | 4/2000 | Matasutani |
| 6,071,163 | A | | 6/2000 | Chang |
| 6,094,000 | A | | 7/2000 | Osamura |
| 6,095,124 | A | | 8/2000 | Matsubara et al. |
| 6,121,719 | A | | 9/2000 | Matsutani |
| 6,166,479 | A | | 12/2000 | Matsutani |
| 6,262,522 | B1 | | 7/2001 | Osamura |
| 6,304,022 | B1 | | 10/2001 | Matsutani |
| 6,326,719 | B1 | | 12/2001 | Boehler et al. |
| 6,407,487 | B1 | | 6/2002 | Sugimoto |
| 6,412,465 | B1 | | 7/2002 | Lykowski |
| 6,523,515 | B2 | | 2/2003 | Kanao |
| 6,533,628 | B1 | | 3/2003 | Matsutani |
| 6,579,738 | B2 | | 6/2003 | Farrar |
| 6,611,083 | B2 | | 8/2003 | LaBarge |
| 6,628,051 | B1 | | 9/2003 | Menken |
| 6,664,719 | B2 | | 12/2003 | Matsutani |
| 6,750,597 | B1 | | 6/2004 | Sakura |
| 6,790,113 | B1 | | 9/2004 | Fujita |
| 6,794,803 | B2 | | 9/2004 | Hori |
| 6,798,125 | B2 | | 9/2004 | Sugiyama |
| 6,864,622 | B2 | | 3/2005 | Matsutani |
| 6,869,328 | B2 | | 3/2005 | Ulm |
| 7,084,558 | B2 | | 8/2006 | Teramura |
| 7,131,191 | B2 | | 11/2006 | Matsutani |
| 7,132,782 | B2 | | 11/2006 | Kato |
| 7,150,252 | B2 | | 12/2006 | Sugiyama |
| 7,164,225 | B2 | | 1/2007 | Yoshimoto |
| 7,221,078 | B2 | | 5/2007 | Watanabe |
| 7,279,827 | B2 | | 10/2007 | Nunome |
| 7,288,879 | B2 | | 10/2007 | Matsutani |
| 7,321,187 | B2 | | 1/2008 | Teramura |
| 7,382,084 | B2 | | 6/2008 | Yoshimoto |
| 7,385,339 | B2 | | 6/2008 | Lineton |
| 7,449,823 | B2 | | 11/2008 | Menken et al. |
| 7,569,979 | B2 | | 8/2009 | Lykowski |
| 7,637,793 | B2 | | 12/2009 | Lintunen et al. |
| 7,815,849 | B2 | | 10/2010 | Koch |
| 2002/0024160 | A1 | | 2/2002 | Sugimoto |
| 2003/0178925 | A1 | | 9/2003 | Kumagai |
| 2004/0140745 | A1 | | 7/2004 | Hrastnik |
| 2005/0168121 | A1 | | 8/2005 | Tinwell |
| 2005/0179353 | A1 | | 8/2005 | Watanabe |
| 2006/0158082 | A1 | | 7/2006 | Menken et al. |
| 2007/0057613 | A1 | | 3/2007 | Brady |
| 2007/0190364 | A1 | | 8/2007 | Das |
| 2007/0236123 | A1 | | 10/2007 | Lykowski |
| 2007/0236124 | A1 | | 10/2007 | Lykowski |
| 2008/0074025 | A1 | | 3/2008 | Hori |
| 2008/0206601 | A1 | | 8/2008 | Mukai |
| 2008/0308057 | A1 | | 12/2008 | Lykowski et al. |
| 2009/0284117 | A1 | | 11/2009 | Ohm |
| 2010/0026159 | A1 | | 2/2010 | Ohm |
| 2010/0052497 | A1 | | 3/2010 | Walker, Jr. |
| 2010/0109502 | A1 | | 5/2010 | Nakayama et al. |
| 2010/0117506 | A1 | | 5/2010 | Suzette |
| 2010/0253203 | A1 | | 10/2010 | Suzuki |
| 2010/0264801 | A1 | | 10/2010 | Tanaka |
| 2010/0264802 | A1 | | 10/2010 | Tanaka |
| 2011/0043093 | A1 | | 2/2011 | Nunome |
| 2011/0127900 | A1 | | 6/2011 | Ma |
| 2011/0198983 | A1 | | 8/2011 | Manhardt |
| 2012/0025690 | A1 | | 2/2012 | Kohl |
| 2012/0025692 | A1 | | 2/2012 | Ma |

FOREIGN PATENT DOCUMENTS

| | | |
|---|---|---|
| GB | 575998 | 3/1946 |
| GB | 717496 | 10/1954 |
| GB | 755835 | 8/1956 |
| GB | 830628 | 3/1960 |
| JP | 2207476 | 8/1990 |
| JP | 7268574 | 10/1995 |
| JP | 8339880 | 12/1996 |
| JP | 2000331770 | 11/2000 |
| JP | 2001262253 | 9/2001 |
| JP | 2002346625 | 12/2002 |
| JP | 2003053419 | 2/2003 |
| JP | 2004031300 | 1/2004 |
| JP | 3902756 | 5/2004 |
| JP | 2004235040 | 8/2004 |
| JP | 2008053017 | 3/2008 |
| JP | 2008053018 | 3/2008 |
| KR | 20020050486 | 6/2002 |

OTHER PUBLICATIONS

International Search Report for PCT/US2010/058501, Aug. 31, 2011, 3 pages.

Written Opinion & International Search Report for PCT/US11/45767 Mar. 20, 2012, 11 pages.

* cited by examiner

150

RUTHENIUM-BASED ELECTRODE MATERIAL FOR A SPARK PLUG

REFERENCE TO RELATED APPLICATIONS

This application claims the benefit of U.S. Provisional Ser. No. 61/429,808 filed on Jan. 5, 2011, the entire contents of which are incorporated herein.

TECHNICAL FIELD

This invention generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

In accordance with one embodiment of the invention, there is provided a ruthenium-based electrode material for use with a spark plug. The electrode material comprises ruthenium (Ru) and a precious metal, wherein the ruthenium (Ru) is the single largest constituent of the electrode material on a wt % basis. Some embodiments of the invention include a spark plug electrode formed from this electrode alloy. Other embodiments include a spark plug having (a) a metallic shell having an axial bore, (b) an insulator having an axial bore and being at least partially disposed within the axial bore of the metallic shell, (c) a center electrode being at least partially disposed within the axial bore of the insulator, and (d) a ground electrode being attached to a free end of the metallic shell, wherein the center electrode, the ground electrode or both includes this electrode alloy. In some embodiments the precious metal may comprise rhodium (Rh) or platinum (Pt). In other embodiments, other precious metals may be used. In a further embodiment, a second precious metal may be included and various relative amounts of the two precious metals may be used such that, whatever the combination, the ruthenium (Ru) is the largest single constituent element of the alloy.

In accordance with another embodiment of the invention, there is provided a ruthenium-based electrode material for use with a spark plug. The electrode material comprises ruthenium (Ru) and at least one precious metal, wherein the electrode material has a density that is less than or equal to about 15.5 g/cm$^3$. Some embodiments of the invention include a spark plug electrode formed from this electrode alloy. Other embodiments include a spark plug having (a) a metallic shell having an axial bore, (b) an insulator having an axial bore and being at least partially disposed within the axial bore of the metallic shell, (c) a center electrode being at least partially disposed within the axial bore of the insulator, and (d) a ground electrode being attached to a free end of the metallic shell, wherein the center electrode, the ground electrode or both includes this electrode alloy. In some embodiments the precious metal may comprise rhodium (Rh) or platinum (Pt). In other embodiments, other precious metals may be used. In a further embodiment, a second precious metal may be included and various relative amounts of the two precious metals may be used such that, whatever the combination, the ruthenium (Ru) is the largest single constituent element of the alloy.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
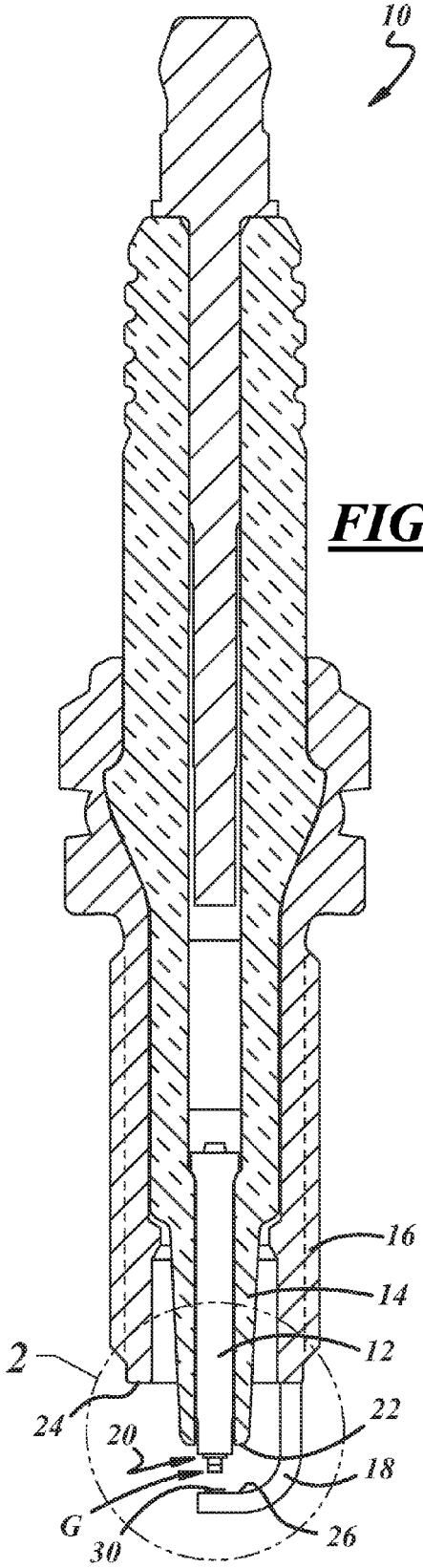
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible.

Figure 2:
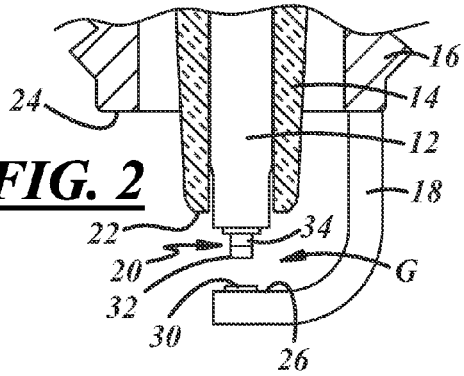
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
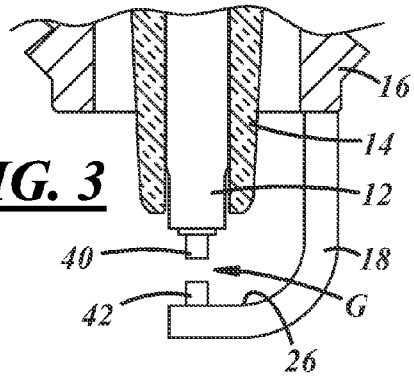
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
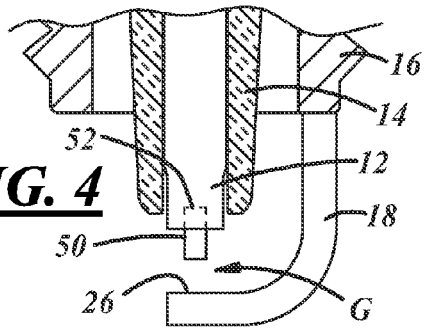
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
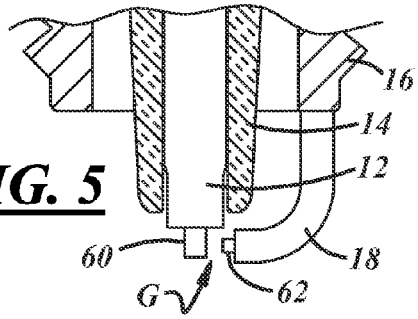
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

According to an exemplary embodiment, the electrode material is a ruthenium-based material that includes ruthenium (Ru) and a precious metal, like rhodium and/or platinum. The term "ruthenium-based material," as used herein, broadly includes any alloy or other electrode material where ruthenium (Ru) is the single largest constituent on a weight % basis. This may include materials having greater than 50% ruthenium, as well as those having less than 50% ruthenium so long as the ruthenium is the single largest constituent. Skilled artisans will appreciate that ruthenium has a rather high melting temperature (2334° C.) compared to some precious metals, which can improve the erosion resistance of the electrode material. However, ruthenium can be more susceptible to oxidation than some precious metals, which can lower the corrosion resistance of the electrode material. Thus, the electrode material disclosed herein may include ruthenium plus one or more additional constituents like precious metals and/or refractory metals, each of which is selected to impart certain properties or attributes to the electrode material. The electrode material may have a microstructure that is single phase (e.g., a solid solution ruthenium (Ru) phase, without any secondary phase or precipitate in the microstructure) and has grain sizes that range from about 5 μm to 100 μm, inclusive. The size of the grains can be determined by using a suitable measurement method, such as the Planimetric method outlined in ASTM E112. Because there are some discrepancies between different periodic tables, a periodic table published by the International Union of Pure and Applied Chemistry (IUPAC) is provided in Addendum A (hereafter the "attached periodic table") that is to be used with the present application.

A "precious metal," as used herein, broadly includes all platinum group metals that are selected from groups 9 or 10 of the attached periodic table. The precious metal may provide the electrode material with a variety of desirable attributes, including a high resistance to oxidation and/or corrosion. Some non-limiting examples of precious metals that are suitable for use in the electrode material include rhodium (Rh), platinum (Pt), palladium (Pd), and iridium (Ir). In an exemplary embodiment, a precious metal is the second greatest or largest constituent of the electrode material on a wt % basis, after ruthenium (Ru), and is present in the electrode material from about 0.1 wt % to about 49.9 wt %, inclusive. Some examples of such an electrode material include Ru—Rh and Ru—Pt alloys. It is also possible for the electrode material to include more than one precious metal and, in at least one embodiment, the electrode material includes ruthenium (Ru) and first and second precious metals. Each of the first and second precious metals may be present in the electrode material from about 0.1 wt % to about 49.9 wt %, inclusive, and the combined amount of the first and second precious metals together is equal to or less than about 50 wt %, inclusive. Some examples of such an electrode material include Ru—Rh—Pt, Ru—Pt—Rh, Ru—Rh—Ir, Ru—Pt—Ir and Ru—Rh—Pt—Ir alloys. In these two-precious metal embodiments, ruthenium (Ru) is still preferably the largest single constituent. One or more additional elements, compounds and/or other constituents may be added to the exemplary electrode materials described above, including refractory metals.

A "refractory metal," as used herein, broadly includes all transition metals that are selected from groups 5-8 of the attached periodic table and have a melting temperature in excess of about 1,700° C. The refractory metal may provide the electrode material with any number of desirable attributes, including a high melting temperature and correspondingly high resistance to spark erosion, as well as improved ductility during manufacturing. Some non-limiting examples of refractory metals that are suitable for use in the electrode material include tungsten (W), molybdenum (Mo), niobium (Nb), tantalum (Ta) and rhenium (Re). In an exemplary embodiment, a refractory metal is the third or fourth greatest or largest constituent of the electrode material on a wt % basis, after ruthenium (Ru) and one or more precious metals, and is present in the electrode material from about 0.1 wt % to about 30 wt %, inclusive. The refractory and precious metals may cooperate with the ruthenium (Ru) in the electrode material such that the electrode has a high wear resistance, including significant resistance to spark erosion, chemical corrosion, and/or oxidation, for example. The relatively high melting points of the refractory metals and the ruthenium may provide the electrode material with a high resistance to spark erosion or wear, while the precious metals may provide the electrode material with a high resistance to chemical corrosion and/or oxidation. In addition, refractory metals like rhenium (Re) may improve the ductility or workability of the electrode material such that it is easier to manufacture and form into components.

A table listing some exemplary precious and refractory metals, as well as their corresponding melting temperatures, is provided below (TABLE I).

TABLE I

Melting Temperatures of Exemplary Metals

| | Melting Temperature (° C.) |
|---|---|
| Precious Metals | |
| Rhodium (Rh) | 1964 |
| Platinum (Pt) | 1768 |
| Palladium (Pd) | 1555 |
| Iridium (Ir) | 2446 |
| Refractory Metals | |
| Tungsten (W) | 3422 |
| Molybdenum (Mo) | 2623 |
| Niobium (Nb) | 2468 |

TABLE I-continued

Melting Temperatures of Exemplary Metals

| | Melting Temperature (° C.) |
|---|---|
| Tantalum (Ta) | 2996 |
| Rhenium (Re) | 3186 |

Figure 6:
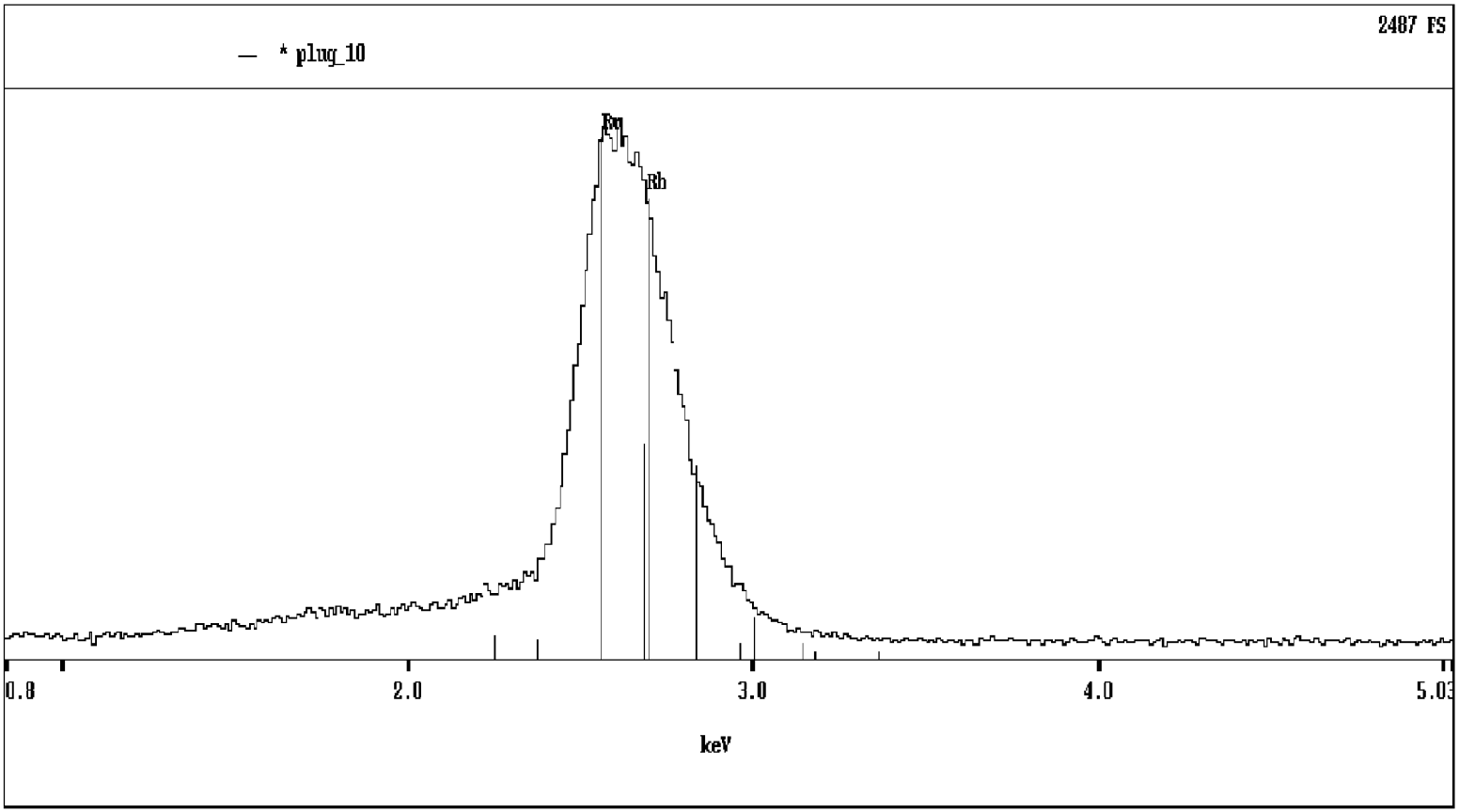
FIG. 6 is an energy dispersive spectroscopy (EDS) spectrum for an exemplary electrode tip, where the electrode tip is rich in rhodium (Rh)

In some instances, the precious metal may improve the wear resistance of the electrode material by forming oxides, such as rhodium oxide ($RhO_2$), which can be more stable than oxides of refractory metals like tungsten oxide. During the oxidation of an electrode material that includes one or more refractory metals and one or more precious metals, the refractory metal(s) can favorably volatize or evaporate from the surface of the electrode material while the precious metal(s) may form stable oxides on the surface. The result may be a protective surface layer comprising precious metal oxides with a sublayer that is rich in precious metal(s). See FIG. 6, which illustrates an Energy Dispersive Spectroscopy (EDS) spectrum for an exemplary electrode tip, and shows that the electrode tip is rich in rhodium (Rh). In this particular graph, the x-axis represents X-ray energy (Key) and the y-axis represents X-ray intensity with unit count per second (CPS). The stable protective surface layer may act to prevent or retard further oxidation of the electrode material and thus prevent mass loss at high temperatures. The protective surface layer is typically dense, stable, and has a high partial vapor pressure and thus a low evaporation rate. Such attributes may contribute to the corrosion and/or erosion resistance characteristics of the electrode material, but the protective surface layer is certainly not necessary. In one embodiment, the stable protective surface layer has a thickness of about 0.1 to 12 microns (μm), includes rhodium oxide ($RhO_2$), and is formed at a temperature of at least 500° C.

Figure 7:
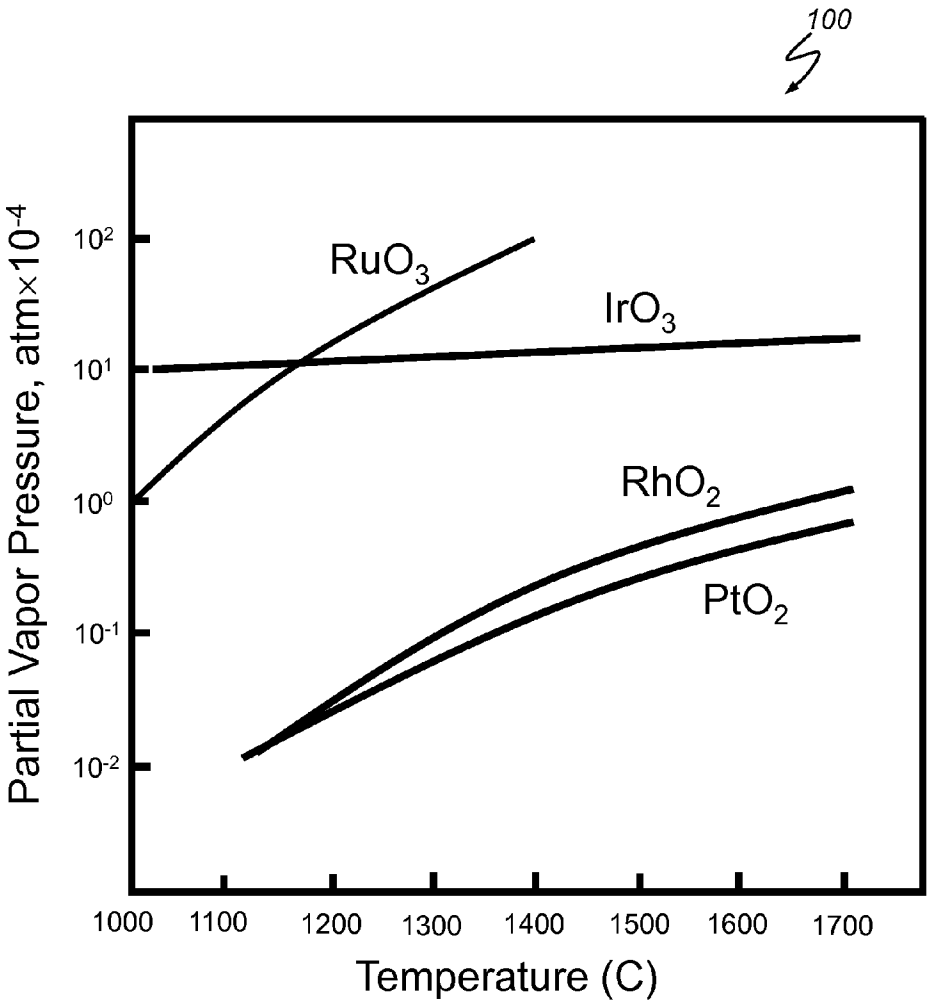
FIG. 7 is a graph showing the partial vapor pressures of several different oxides.

With reference to FIG. 7, there is shown a temperature-dependent graph 100 that illustrates the partial vapor pressure behavior of several oxides. Temperature (° C.) is on the x-axis and partial vapor pressure ($atm \times 10^{-4}$) is on the y-axis. As demonstrated in graph 100, ruthenium- and iridium-oxides have a higher partial vapor pressure than corresponding rhodium- and platinum-oxides, and therefore ruthenium and iridium may exhibit a higher corrosion- or oxidation-related deterioration (i.e., mass loss) than rhodium and platinum. Comparing ruthenium- and iridium-oxides, the ruthenium-oxide exhibits better oxidation resistance below about 1150° C., while the iridium-oxide shows better oxidation resistance above this temperature. For ruthenium-based materials, like the Ru—Rh, Ru—Pt, Ru—Rh—Pt and Ru—Pt—Rh materials described herein, the addition of the precious metals Rh and Pt can not only reduce the oxidation activity of the overall material, it can also help form the protective surface layer described above. Skilled artisans will appreciate that one of any number of different techniques may be used to detect and analyze such surface layers, including performing chemical analysis on the electrode and/or by evaluating an Energy Dispersive Spectra (EDS) with a Scanning Electron Microscopy (SEM) instrument. Other techniques or methods may be employed as well. Moreover, the protective surface layer may be present along the entire outer surface of the electrode that is exposed to the combustion chamber or only along portions of the outer surface that are sparking surfaces, but is generally not present in the interior or bulk of the electrode.

In some instances, it may be advantageous for the electrode material to have certain density characteristics. For example, electrode materials are oftentimes sold and priced according to their mass (e.g., in $/gram). Thus, the less dense the electrode material, the lower its mass and the less it may cost on a volume basis. According to an exemplary embodiment, the electrode material is a ruthenium-based electrode material that includes at least one precious metal and has a density that is less than or equal to about 15.5 g/cm$^3$. A table listing some exemplary electrode materials that fall within this embodiment, as well as their corresponding densities, is provided below (TABLE II). Electrode materials Pt-44Ru and Ir-2Rh are provided for purposes of comparison.

TABLE II

Densities of Exemplary Electrode Materials

| Electrode Material | Density (g/cm$^3$) |
|---|---|
| Ru—10Rh—1Re | 12.33 |
| Ru—20Rh | 12.33 |
| Ru—5Rh—1Re | 12.34 |
| Ru—2.5Pt—2.5Rh—1Re | 12.48 |
| Ru—5Pt—5Rh—1Re | 12.56 |
| Ru—10Pt—10Rh | 12.78 |
| Ru—20Pt | 13.22 |
| Pt—44Ru | 15.88 |
| Ir—2Rh | 22.14 |

In one embodiment, the electrode material is a ruthenium-based material that includes ruthenium (Ru) from about 50 wt % to about 99.9 wt %, inclusive, and a precious metal from about 0.1 wt % to about 49.9 wt %, inclusive, where the ruthenium (Ru) is the single largest constituent of the electrode material on a wt % basis. Rhodium (Rh) or platinum (Pt), for example, may be the precious metal referred to above. Examples of suitable electrode material compositions that fall within this exemplary embodiment include those compositions having ruthenium (Ru) plus one precious metal selected from the group of rhodium (Rh), platinum (Pt), palladium (Pd) and/or iridium (Ir), such as Ru—Rh, Ru—Pt, Ru—Pd and Ru—Ir. Such compositions may include the following non-limiting examples: Ru-45Rh, Ru-40Rh, Ru-35Rh, Ru-30Rh, Ru-25Rh, Ru-20Rh, Ru-15Rh, Ru-10Rh, Ru-5Rh, Ru-2Rh, Ru-1Rh, Ru-45Pt, Ru-40Pt, Ru-35Pt, Ru-30Pt, Ru-25Pt, Ru-20Pt, Ru-15Pt, Ru-10Pt, Ru-5Pt, Ru-2Pt, Ru-1Pt; other examples are certainly possible. In one particular embodiment, the electrode material is a ruthenium-based material that includes ruthenium (Ru) from about 80 wt % to about 99.9 wt %, inclusive, and rhodium (Rh) from about 0.1 wt % to about 20 wt %.

In another embodiment, the electrode material is a ruthenium-based material that includes ruthenium (Ru) from about 35 wt % to about 99.9 wt %, inclusive, a first precious metal from about 0.1 wt % to about 49.9 wt %, inclusive, and a second precious metal from about 0.1 wt % to about 49.9 wt %, inclusive, where the ruthenium (Ru) is the single largest constituent of the electrode material. Ruthenium-based materials that include rhodium (Rh) and platinum (Pt), where the combined amount of rhodium (Rh) and platinum (Pt) is between 1%-65%, inclusive, may be particularly useful for certain spark plug applications. Examples of suitable electrode material compositions that fall within this exemplary embodiment include those compositions having ruthenium (Ru) plus two or more precious metals selected from the group of rhodium (Rh), platinum (Pt), palladium (Pd) and/or iridium (Ir), such as Ru—Rh—Pt, Ru—Rh—Pd, Ru—Rh—Ir, Ru—Pt—Rh, Ru—Pt—Pd, Ru—Pt—Ir, Ru—Pd—Rh, Ru—Pd—Pt, Ru—Pd—Ir, Ru—Ir—Rh, Ru—Ir—Pt, Ru—Ir—Pd, Ru—Rh—Pt—Ir, Ru—Rh—Pt—Pd, Ru—Pt—Rh—Ir, Ru—Pt—Rh—Pd, etc. Such compositions may include the following non-limiting examples: Ru-30Rh-30Pt, Ru-35Rh-25Pt, Ru-35Pt-25Rh, Ru-25Rh-25Pt; Ru-30Rh-20Pt, Ru-30Pt-20Rh, Ru-20Rh-20Pt, Ru-25Rh-15Pt, Ru-25Pt-15Rh, Ru-15Rh-15Pt, Ru-20Rh-10Pt, Ru-20Pt-10Rh, Ru-10Rh-10Pt, Ru-15Rh-5Pt, Ru-15Pt-5Rh, Ru-5Rh-5Pt, Ru-10Rh-1Pt, Ru-10Pt-1Rh, Ru-2Rh-2Pt, Ru-1Rh-1Pt, Ru-30Rh-20Ir, Ru-30Pt-20Ir, Ru-30Ir-20Rh, Ru-30Ir-20Pt, Ru-40Rh-10Pt, Ru-40Rh-10Ir, Ru-40Pt-10Rh, Ru-40Pt-10Ir, Ru-40Ir-10Rh, and Ru-40Ir-10Pt; other examples are certainly possible.

According to another exemplary embodiment, the electrode material is a ruthenium-based material that includes ruthenium (Ru) from about 35 wt % to about 99.9 wt %, inclusive, one or more precious metals from about 0.1 wt % to about 49.9 wt %, inclusive, and a refractory metal from about 0.1 wt % to about 30 wt %, inclusive, where the ruthenium (Ru) is the single largest constituent of the electrode material. Tungsten (W), molybdenum (Mo), niobium (Nb), tantalum (Ta) and/or rhenium (Re), for example, may be a suitable refractory metal for the electrode material. Refractory metals may be used to strengthen the electrode material in one or more ways or to lower the overall cost, for instance. In one embodiment, a refractory metal constitutes the greatest constituent in the electrode material after ruthenium (Ru) and one or more precious metals, and is present in an amount that is greater than or equal to 0.1 wt % and is less than or equal to 30 wt %. Examples of suitable electrode material compositions that fall within this exemplary embodiment include Ru—Rh—W, Ru—Rh—Mo, Ru—Rh—Nb, Ru—Rh—Ta, Ru—Rh—Re, Ru—Pt—W, Ru—Pt—Mo, Ru—Pt—Nb, Ru—Pt—Ta, Ru—Pt—Re, Ru—Rh—Pt—W, Ru—Rh—Pt—Mo, Ru—Rh—Pt—Nb, Ru—Rh—Pt—Ta, Ru—Rh—Pt—Re, Ru—Pt—Rh—W, Ru—Pt—Rh—Mo, Ru—Pt—Rh—Nb, Ru—Pt—Rh—Ta, Ru—Pt—Rh—Re, etc. Numerous compositional combinations of this embodiment are possible.

Depending on the particular embodiment and the particular properties that are desired, the amount of ruthenium (Ru) in the ruthenium-based material may be: greater than or equal to 35 wt %, 50 wt %, 65 wt % or 80 wt %; less than or equal to 99.9%, 95 wt %, 90 wt % or 85 wt %; or between 35-99.9%, 50-99.9 wt %, 65-99.9 wt % or 80-99.9 wt %, to cite a few examples. Likewise, the amount of rhodium (Rh) in the ruthenium-based material may be: greater than or equal to 0.1 wt %, 2 wt %, 10 wt % or 20 wt %; less than or equal to 49.9 wt %, 40 wt %, 20 wt % or 10 wt %; or between 0.1-49.9 wt %, 0.1-40 wt %, 0.1-20 wt % or 0.1-10 wt %. The amount of platinum (Pt) in the ruthenium-based material may be: greater than or equal to 0.0 wt %, 2 wt %, 10 wt % or 20 wt %; less than or equal to 49.9 wt %, 40 wt %, 20 wt % or 10 wt %; or between 0.1-49.9 wt %, 0.1-40 wt %, 0.1-20 wt % or 0.1-10 wt %. The amount of rhodium (Rh) and platinum (Pt) combined or together in the ruthenium-based material may be: greater than or equal to 1 wt %, 5 wt %, 10 wt % or 20 wt %; less than or equal to 65 wt %, 50 wt %, 35 wt % or 20 wt %; or between 1-65 wt %, 1-50 wt %, 1-35 wt % or 1-20 wt %. The amount of a refractory metal—i.e., a refractory metal other than ruthenium (Ru)—in the ruthenium-based material may be: greater than or equal to 0.1 wt %, 1 wt %, 2 wt % or 5 wt %; less than or equal to 10 wt %, 8 wt % or 5 wt %; or between 0.1-10 wt %, 0.1-8 wt % or 0.1-5 wt %. The same percentage ranges apply to hafnium (Hf), nickel (Ni) and/or gold (Au), as introduced below. The preceding amounts, percentages, limits, ranges, etc. are only provided as examples of some of the different electrode material embodiments that are possible, and are not meant to limit the scope of the electrode material.

Other constituents, such as hafnium (Hf), nickel (Ni) and/or gold (Au), may also be added to the electrode material. In one instance, a suitable electrode material composition includes some combination of ruthenium (Ru), rhodium (Rh), platinum (Pt) and hafnium (Hf), nickel (Ni) and/or gold (Au), such as Ru—Rh—Hf, Ru—Rh—Ni, Ru—Rh—Au, Ru—Pt—Hf, Ru—Pt—Ni, Ru—Pt—Au, Ru—Rh—Pt—Hf, Ru—Rh—Pt—Ni, Ru—Rh—Pt—Au, Ru—Pt—Rh—Hf, Ru—Pt—Rh—Ni, Ru—Pt—Rh—Au, Ru—Rh—Pt—Hf—Ni, Ru—Pt—Rh—Hf—Ni, Ru—Rh—Pt—Ni—Hf, Ru—Pt—Rh—Ni—Hf, etc.

It should be appreciated that the preceding electrode material examples represent only some of the possible compositions. Other ruthenium-based binary, ternary, quaternary and other alloys may also exist. Some examples of electrode material compositions that may be particularly useful for certain spark plug applications include: Ru—Rh where the Rh is between 0.1-20% wt, Ru—Rh—Ir where the Rh is between 0.1-20% wt and the Ir is between 0.1-10% wt, Ru—Rh—Re where the Rh is between 0.1-20% wt and the Re is between 0.1-2% wt, Ru—Pd—Re where the Pd is between 0.1-20% wt and the Re is between 0.1-2% wt, and Ru—Rh—Ir—Re where the Rh is between 0.1-20% wt, the Ir is between 0.1-10% wt, and the Re is between 0.1-2% wt. In some of the preceding exemplary systems, the rhenium (Re) is added to improve the overall ductility of the electrode material so that it can be more easily manufactured.

The electrode material can be made using a variety of metallurgical processes, such as powder metallurgy methods, like powder sintering, powder melting, arc melting, etc. For instance, a process may be used that includes the steps of: choosing powder sizes for each of the constituents, blending the powders together to form a powder mixture, compressing the powder mixture under high isostatic pressure and/or high temperature to a desired shape, and sintering the compressed powder to form the electrode material. This process can be used to form the electrode material into shapes (such as rods, wires, sheets, etc.) suitable for further spark plug electrode and/or firing tip manufacturing processes. Other known techniques such as melting and blending the desired amounts of each constituent may be used in addition to or in lieu of those steps mentioned above. The electrode material can be further processed using conventional cutting and grinding techniques that are sometimes difficult to use with other known erosion-resistant electrode materials.

Hot Spark Test—

A test was conducted to compare the hot spark erosion rate of different spark plug materials. Firing tips made from various materials, including the present ruthenium-based electrode material, were attached to Ni-based electrode base members and were subjected to conditions similar to those found in internal combustion engines. The firing tips had a diameter of about 0.7 mm and a thickness of about 1.0 mm. In this particular test, the firing tips were tested as cathodes for 300 hours, during which time they were maintained at a temperature of about 775° C. and a pressure of about 20 kilopounds per square inch (KSI) while a sparking voltage of 20 kilovolts (Kv) was applied at a sparking frequency of 158 Hz. The amount of material worn away on the firing tip was measured and used to determine the hot spark erosion rate, which is simply the amount of material worn away per spark applied to the firing tip. The hot spark erosion rate provides an indication of the volume stability of the different spark plug materials and, in this particular instance, is represented in terms of $\mu m^3$/spark. Skilled artisans will appreciate that the hot spark erosion rate generally indicates the volume instability or loss of material based on two deterioration mechanisms: spark erosion and high temperature oxidation or corrosion.

Figure 8:
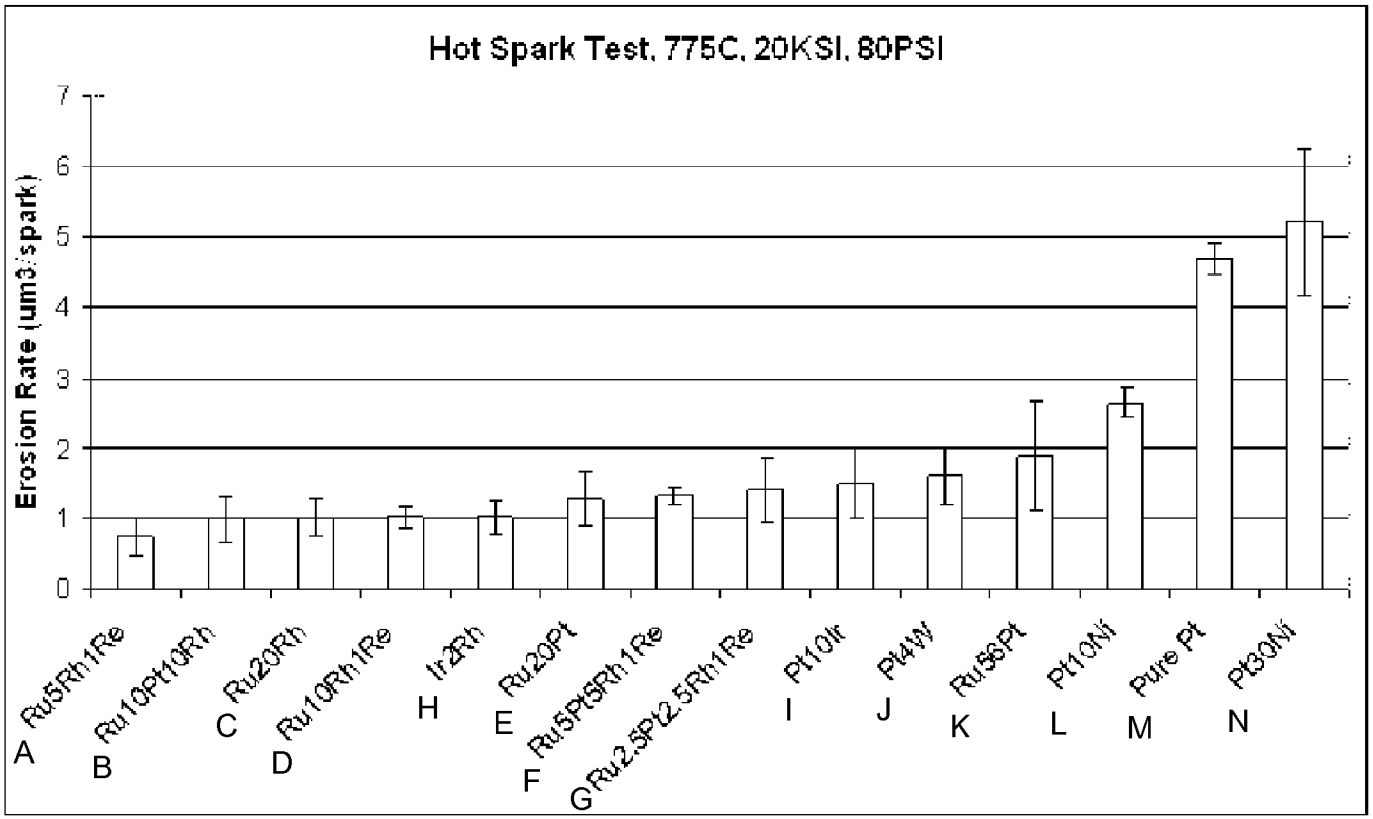
FIG. 8 is a graph showing the erosion rates of a number of different electrode materials when subjected to a hot spark test.

The results of the hot spark test are shown in graph 150 FIG. 8 and TABLE III, where samples A-G are different embodiments of the present ruthenium-based electrode material and samples H-N are other comparative electrode materials. The exemplary embodiments of the electrode material that are represented by samples A-G have tested well.

TABLE III

| | Ru | Rh | Pt | Re | Ir | Al | W | Ni | Erosion Rate ($\mu m^3$/spark) |
|---|---|---|---|---|---|---|---|---|---|
| Ex. A | 94.0 | 5.0 | | 1.0 | | | | | 0.7 |
| Ex. B | 80.0 | 10.0 | 10.0 | | | | | | 1.0 |
| Ex. C | 80.0 | 20.0 | | | | | | | 1.0 |
| Ex. D | 89.0 | 10.0 | | 1.0 | | | | | 1.1 |
| Ex. E | 80.0 | | 20.0 | | | | | | 1.2 |
| Ex. F | 89.0 | 5.0 | 5.0 | 1.0 | | | | | 1.3 |
| Ex. G | 94.0 | 2.5 | 2.5 | 1.0 | | | | | 1.4 |
| Ex. H | | 2.0 | | | 98.0 | | | | 1.1 |
| Ex. I | | | 90.0 | | 10.0 | | | | 1.5 |
| Ex. J | | | 96.0 | | | | 4.0 | | 1.6 |
| Ex. K | 44.0 | | 56.0 | | | | | | 1.8 |
| Ex. L | | | 90.0 | | | | | 10.0 | 2.6 |
| Ex. M | | | 100.0 | | | | | | 4.8 |
| Ex. N | | | 70.0 | | | | | 30.0 | 5.2 |

Samples I-N are all platinum-based materials, meaning that platinum (Pt) is the single largest constituent of the material, on a weight basis. In each of these cases, the materials includes more than 50% platinum (Pt). The hot spark erosion rate of samples I-N ranges from about 1.5 $\mu m^3$/spark to about 5.2 $\mu m^3$/spark. Sample H is an iridium-based material that includes 98% iridium and exhibits spark erosion rates of about 1.1 $\mu m^3$/spark. Lastly, samples A-G are ruthenium-based materials, where the ruthenium (Ru) content is greater than or equal to 80%. Samples C and E are binary alloys, samples A, B and D are ternary alloys, and samples F and G are quaternary alloys, all of which include ruthenium as the single largest constituent. As illustrated by graph 150, the hot spark erosion rate of samples A-G are between about 0.7-1.4 $\mu m^3$/spark, which is better than the platinum-based alloys tested. Moreover, ruthenium-based materials typically cost less than corresponding platinum- or iridium-based materials and are thus more cost effective as a spark plug electrode material.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items.

Other terms are to be construed using their broadest reasonable meaning unless they are used in a context that requires a different interpretation.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode or both includes an electrode material having ruthenium (Ru), a precious metal, and a refractory metal, wherein the ruthenium (Ru) is the single largest constituent of the electrode material on a wt % basis and the refractory metal is present in the electrode material from about 0.1 wt % to about 10 wt %, inclusive.

2. The spark plug of claim 1, wherein the precious metal is the second largest constituent of the electrode material on a wt % basis, and the precious metal is present in the electrode material from about 0.1 wt % to about 49.9 wt %, inclusive.

3. The spark plug of claim 1, wherein the precious metal includes at least one element selected from the group consisting of: rhodium (Rh), platinum (Pt), palladium (Pd), and iridium (Ir).

4. The spark plug of claim 1, wherein the refractory metal is selected from the group consisting of: tungsten (W), molybdenum (Mo), niobium (Nb), tantalum (Ta), and rhenium (Re).

5. The spark plug of claim 1, wherein the electrode material includes ruthenium (Ru), a first precious metal and a second precious metal, and each of the first and second precious metals is present in the electrode material from about 0.1 wt % to about 49.9 wt %, inclusive.

6. The spark plug of claim 1, wherein the electrode material includes a protective surface layer where the ruthenium (Ru) has volatized or evaporated and the precious metal has formed a stable oxide.

7. The spark plug of claim 6, wherein the protective surface layer has a thickness of about 0.1 to 12 microns (μm) and includes rhodium oxide ($RhO_2$).

8. The spark plug of claim 1, wherein the electrode material includes ruthenium (Ru) from about 50 wt % to about 99.9 wt %, inclusive, and rhodium (Rh) from about 0.1 wt % to about 49.9 wt %, inclusive.

9. The spark plug of claim 1, wherein the electrode material includes ruthenium (Ru) from about 50 wt % to about 99.9 wt %, inclusive, and platinum (Pt) from about 0.1 wt % to about 49.9 wt %, inclusive.

10. The spark plug of claim 1, wherein the electrode material includes ruthenium (Ru) from about 35 wt % to about 99.9 wt %, inclusive, rhodium (Rh) from about 0.1 wt % to about 49.9 wt %, inclusive, and platinum (Pt) from about 0.1 wt % to about 49.9 wt %, inclusive.

11. The spark plug of claim 1, wherein the center electrode, the ground electrode or both includes an attached firing tip that is at least partially made from the electrode material.

12. The spark plug of claim 11, wherein the firing tip is a multi-piece rivet that includes a second component attached to the center electrode or the ground electrode, and a first component that is attached to the second component and is at least partially made from the electrode material.

13. The spark plug of claim 1, wherein the center electrode, the ground electrode or both is at least partially made from the electrode material and does not include an attached firing tip.

14. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell, wherein the center electrode, the ground electrode or both includes an electrode material having ruthenium (Ru), a precious metal, and at least one of gold (Au) or nickel (Ni), wherein the ruthenium (Ru) is the single largest constituent of the electrode material on a wt % basis.

15. A ruthenium-based electrode material for use with a spark plug, comprising:

ruthenium (Ru), a precious metal, and a refractory metal, wherein the ruthenium (Ru) is the single largest constituent of the electrode material on a wt % basis and the refractory metal is present in the electrode material from about 0.1 wt % to about 10 wt %, inclusive.

16. The ruthenium-based electrode material of claim 15, wherein the precious metal is selected from the group consisting of: rhodium (Rh) and platinum (Pt).

17. The ruthenium-based electrode material of claim 15, wherein the precious metal comprises a first precious metal in an amount greater than or equal to 0.1 wt % and less than or equal to 49.9 wt %, wherein the electrode material further comprises a second precious metal in an amount greater than or equal to 0.1 wt % and less than or equal to 49.9 wt %, and wherein the amount of the first and second precious metals together is equal to or less than 65 wt % and the ruthenium (Ru) is the single largest constituent of the electrode material on a wt % basis.

18. A spark plug electrode comprising the ruthenium-based electrode material of claim 15.

19. The spark plug electrode of claim 18, wherein the precious metal comprises a first precious metal and wherein the electrode material comprises a second precious metal, and wherein both the first and second precious metals are selected from the group consisting of: rhodium (Rh), platinum (Pt), palladium (Pd), and iridium (Ir).

20. The spark plug electrode of claim 18, wherein the precious metal comprises rhodium (Rh) and wherein the electrode alloy comprises at least one other constituent.

21. A ruthenium-based electrode material for use with a spark plug, comprising:

ruthenium (Ru), at least one precious metal, and a refractory metal present in the electrode material from about 0.1 wt % to about 10 wt %, inclusive, wherein the ruthenium (Ru) is the single largest constituent of the electrode material on a wt % basis, and wherein the electrode material has a density that is less than or equal to about 15.5 $g/cm^3$.

22. A spark plug electrode comprising the ruthenium-based electrode material of claim 21.

* * * * *